US011774892B2

(12) United States Patent
Yamamoto et al.

(10) Patent No.: US 11,774,892 B2
(45) Date of Patent: Oct. 3, 2023

(54) FIXING APPARATUS CONTAINING NON-ROTARY PAD AND PRESSURE APPLICATION PART, AND IMAGE FORMING APPARATUS CONTAINING SAME

(71) Applicant: Konica Minolta, Inc., Tokyo (JP)

(72) Inventors: Naoki Yamamoto, Toyohashi (JP); Etsuaki Urano, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/804,111

(22) Filed: May 26, 2022

(65) Prior Publication Data

US 2022/0390884 A1 Dec. 8, 2022

(30) Foreign Application Priority Data

Jun. 7, 2021 (JP) ..... 2021-095244

(51) Int. Cl.
*G03G 15/20* (2006.01)

(52) U.S. Cl.
CPC ..... *G03G 15/2064* (2013.01)

(58) Field of Classification Search
CPC ..... G03G 15/2053; G03G 15/2064
USPC ..... 399/328
See application file for complete search history.

(56) References Cited

U.S. PATENT DOCUMENTS

2014/0270869 A1* 9/2014 Okabayashi ..... G03G 15/2053 399/329
2015/0125193 A1* 5/2015 Ishii ..... G03G 15/2042 399/329

FOREIGN PATENT DOCUMENTS

JP 2006-038990 A 2/2006
JP 2017-090885 A 5/2017

* cited by examiner

*Primary Examiner* — Quana Grainger
(74) *Attorney, Agent, or Firm* — LUCAS & MERCANTI, LLP

(57) ABSTRACT

Provided is a fixing apparatus that fixes an unfixed image on a sheet by causing the sheet to pass through a fixing nip formed by pressing a belt by a pressurizing roller, a lubricant being applied on an inner peripheral surface of the belt, the pressurizing roller being disposed on an outer peripheral side of the belt, and the fixing apparatus includes: a non-rotary pad including a pressed part disposed on an inner peripheral side of the belt and pressed by the pressurizing roller via the belt, and a guide that is disposed upstream of the pressed part in a belt circulating direction and guides the belt to the fixing nip; and a pressure application part that applies a pressure between an end of the belt in a belt width direction and the guide at a position upstream of and immediately before the fixing nip in the belt circulating direction.

15 Claims, 11 Drawing Sheets

FIXING APPARATUS CONTAINING NON-ROTARY PAD AND PRESSURE APPLICATION PART, AND IMAGE FORMING APPARATUS CONTAINING SAME

The entire disclosure of Japanese patent Application No. 2021-095244, filed on Jun. 7, 2021, is incorporated herein by reference in its entirety.

BACKGROUND

Technological Field

The present disclosure relates to a fixing apparatus and an image forming apparatus that fix an unfixed image on a recording sheet.

Description of the Related Art

An image forming apparatus such as a printer includes a fixing apparatus of a pad-fixing system that presses a fixed pad, which is a non-rotary member disposed on the inner peripheral side of an endless belt that circulates, with a pressurizing roller disposed on the outer peripheral side of the belt via the belt to form a fixing nip between the belt and the pressurizing roller, and causes a sheet to pass through the fixing nip to fix an unfixed image on the sheet (For example, JP 2017-90885 A and JP 2006-38990 A).

In such a pad-fixing system, since the pressing force generated between the pressurizing roller and the fixed pad via the belt is large, the frictional resistance between the belt and the fixed pad also increases, and the wear of the inner peripheral surface of the belt easily progresses. Therefore, conventionally, a lubricant is applied on the inner peripheral surface of the belt to reduce frictional resistance between the belt and the fixed pad.

However, since the pressure of the fixing nip is considerably high, the lubricant applied on the inner peripheral surface of the belt tends to be divided into one that can enter between the belt and the fixed pad when passing through the fixing nip and one that cannot enter between the belt and the fixed pad and flows to the end side in the width direction of the belt (corresponding to the axial direction of the pressurizing roller). The lubricant flowing to the end side eventually leaks out of the belt from the edge in the width direction of the belt. Since the lubricant leaks from the edge of the belt in the width direction, the amount of lubricant on the inner peripheral surface of the belt is reduced, and as the amount of the lubricant on the inner peripheral surface of the belt decreases, the frictional resistance between the belt and the fixed pad increases. Due to the increase in the frictional resistance, the progress of wear of the belt may be accelerated, or the smooth rotation of the belt or the pressurizing roller may be hindered due to an increase in the torque for driving the belt, leading to occurrence of sheet conveyance failure.

JP 2017-90885 A discloses a configuration in which an end of a nip formation pad (fixed pad) on the upstream side in a belt circulating direction is formed in a comb-teeth shape over the entire region from one end to the other end in the width direction of the belt, and discloses that the lubricant enters comb-teeth-shaped recesses (grooves) and thus can be prevented from leaking out from an edge end in the width direction of the belt.

In the above configuration, the lubricant can be stored in the comb-shaped recesses formed in the nip formation member. However, in a state where the lubricant is stored in a recess to some extent, when a new lubricant applied on the inner peripheral surface of the belt is about to enter the recess as the belt circulates, the new lubricant tends to be not fully accommodated by the recess and overflow. When a phenomenon that the overflowed lubricant flows to an adjacent recess in the belt width direction, then the adjacent recess also overflows, and the overflowed lubricant flows to a next adjacent recess continues, the lubricant gradually flows toward the end side in the belt width direction, and there is a possibility that the lubricant leaks to the outside from the belt edge in the belt width direction after all.

SUMMARY

The present disclosure has been made in view of the above problems, and an object of the present disclosure is to provide a fixing apparatus and an image forming apparatus capable of preventing a lubricant from leaking out of a belt as much as possible in a pad-fixing system.

To achieve the abovementioned object, according to an aspect of the present invention, there is provided a fixing apparatus that fixes an unfixed image on a sheet by causing the sheet to pass through a fixing nip formed by pressing a belt by a pressurizing roller, the belt having an endless shape, a lubricant being applied on an inner peripheral surface of the belt, the pressurizing roller being disposed on an outer peripheral side of the belt, and the fixing apparatus reflecting one aspect of the present invention comprises: a non-rotary pad including a pressed part disposed on an inner peripheral side of the belt and pressed by the pressurizing roller via the belt, and a guide that is disposed upstream of the pressed part in a belt circulating direction and guides the belt to the fixing nip; and a pressure application part that applies a pressure between an end of the belt in a belt width direction and the guide at a position that is upstream of and immediately before the fixing nip in the belt circulating direction, the pressure gradually decreasing from the end side toward a central side in the belt width direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, a fixing apparatus and an image forming apparatus according to one or more embodiments of the present invention will be described with reference to the drawings, taking a color printer of a tandem type (hereinafter, the printer will be simply referred to as a "printer") as an example. However, the scope of the invention is not limited to the disclosed embodiments.

(1) Overall Configuration of Printer

Figure 1:
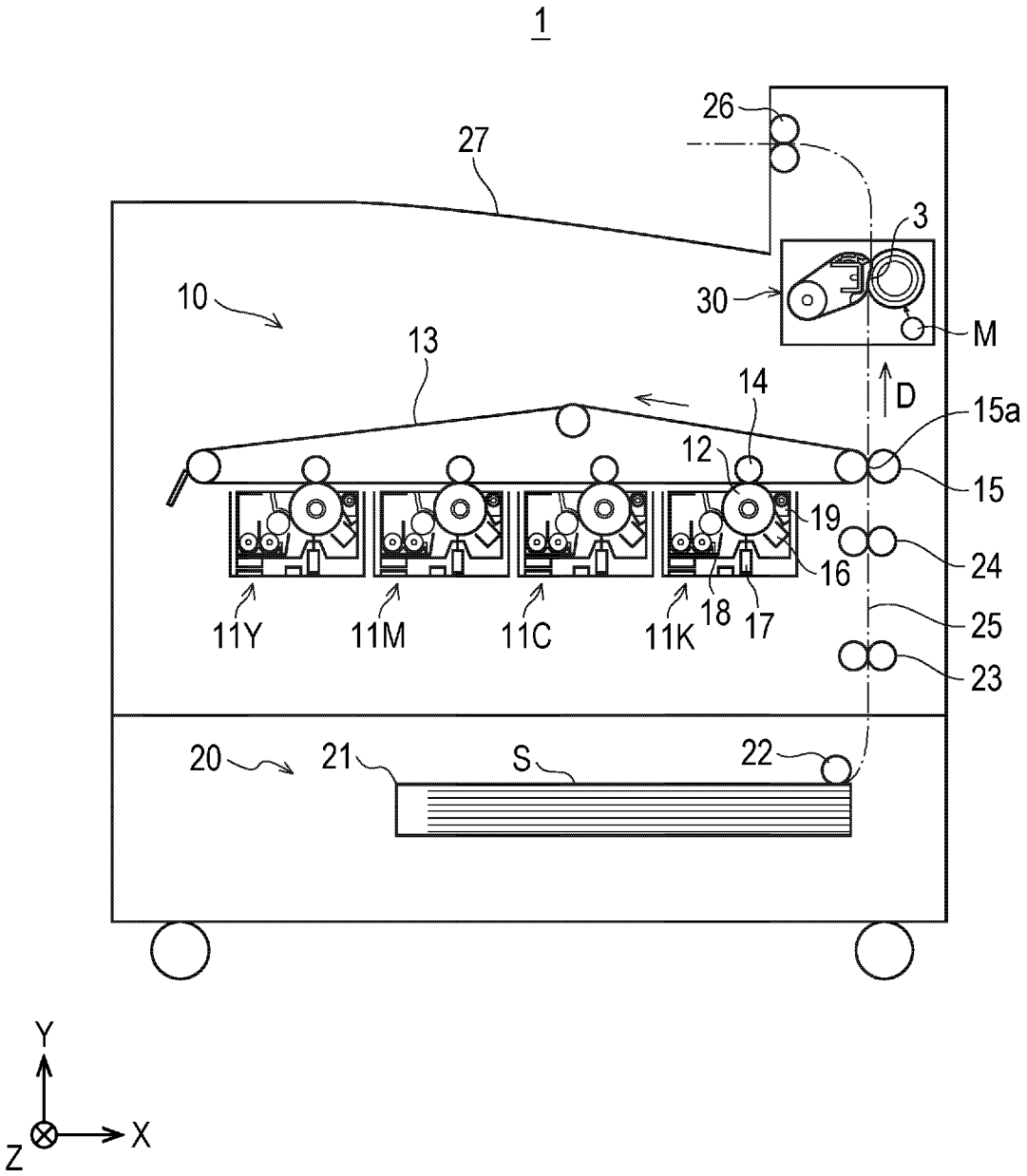
FIG. 1 is a schematic diagram illustrating an overall configuration of a printer.

FIG. 1 is a schematic section view illustrating an overall configuration of a printer 1.

As illustrated in FIG. 1, the printer 1 includes an image forming section 10, a sheet feeding unit 20, and a fixing part 30.

The image forming section 10 includes image forming units 11Y, 11M, 11C, and 11K corresponding to respective colors of yellow (Y), magenta (M), cyan (C), and black (K), and an intermediate transfer belt 13.

The image forming unit 11K includes a photosensitive drum 12, and a charging unit 16, an exposure unit 17, a developing unit 18, and a cleaner 19 arranged along the circumferential direction of the photosensitive drum 12.

The exposure unit 17 includes a light emitting element such as a laser diode, a lens, and the like, and modulates laser light according to a drive signal from an unillustrated control unit to expose the photosensitive drum 12 in a scanning manner.

The photosensitive drum 12 is rotationally driven by an unillustrated drive source, and is uniformly charged by the charging unit 16 after residual toner on the surface is removed by the cleaner 19 before being exposed, and an electrostatic latent image is formed on the surface of the photosensitive drum 12 when the photosensitive drum 12 is exposed to the laser light in this uniformly charged state.

The electrostatic latent image formed on the photosensitive drum 12 is developed by the developing unit 18, and thus a toner image of K color is formed on the surface of the photosensitive drum 12. The toner of the K color is transferred from the photosensitive drum 12 onto the intermediate transfer belt 13 through primary transfer by a primary transfer roller 14 disposed on the side opposite to the photosensitive drum 12 with the circulating intermediate transfer belt 13 therebetween.

The image forming units 11Y, 11M, and 11C also have the same configuration as the image forming unit 11K, and for each image forming unit, a toner image of a corresponding color (Y, M or C color) is formed on the photosensitive drum 12 and transferred onto the intermediate transfer belt 13 through primary transfer by the primary transfer roller 14.

The image forming operation in each of the image forming units 11Y to 11K is executed at different timings so that the toner images are transferred through primary transfer to the same position on the intermediate transfer belt 13. Thus, color toner images of Y to K colors are formed on the intermediate transfer belt 13.

The sheet feeding unit 20 includes a sheet feeding cassette 21 that houses recording sheet S, a feeding roller 22, a conveyance roller 23, and a timing roller 24.

The feeding roller 22 comes into contact with the uppermost recording sheet S in the sheet feeding cassette 21 and feeds the uppermost recording sheet S to the conveyance path 25. The conveyance roller 23 conveys the recording sheet S fed by the feeding roller 22 toward the timing roller 24. The timing roller 24 sends out the recording sheet S to the downstream side at a timing instructed by an unillustrated control unit.

The color toner image transferred as a combination onto the intermediate transfer belt 13 in the image forming section 10 is moved to a secondary transfer position 15*a* which is a contact position between the intermediate transfer belt 13 and the secondary transfer roller 15 by the circulation of the intermediate transfer belt 13.

The recording sheet S is fed on the conveyance path 25 from the timing roller 24 of the sheet feeding unit 20 in accordance with the movement timing of the toner image on the circulating intermediate transfer belt 13, and when the recording sheet S passes through the secondary transfer position 15*a*, the color toner image on the intermediate transfer belt 13 is transferred onto the recording sheet S through secondary transfer by the secondary transfer roller 15. The recording sheet S having passed through the secondary transfer position 15*a* is sent to the fixing part 30.

The fixing part 30 causes the recording sheet S conveyed in a direction (sheet conveyance direction) indicated by an arrow D from the secondary transfer roller 15 to pass through the fixing nip 3, and fixes the color toner image (unfixed image) on the recording sheet S to the recording sheet S by heating and pressurizing the toner image.

The recording sheet S having passed through the fixing part 30 is discharged to the outside of the apparatus by the discharge roller 26, and is stored on a discharge tray 27.

(2) Configuration of Fixing Part

Figure 2:
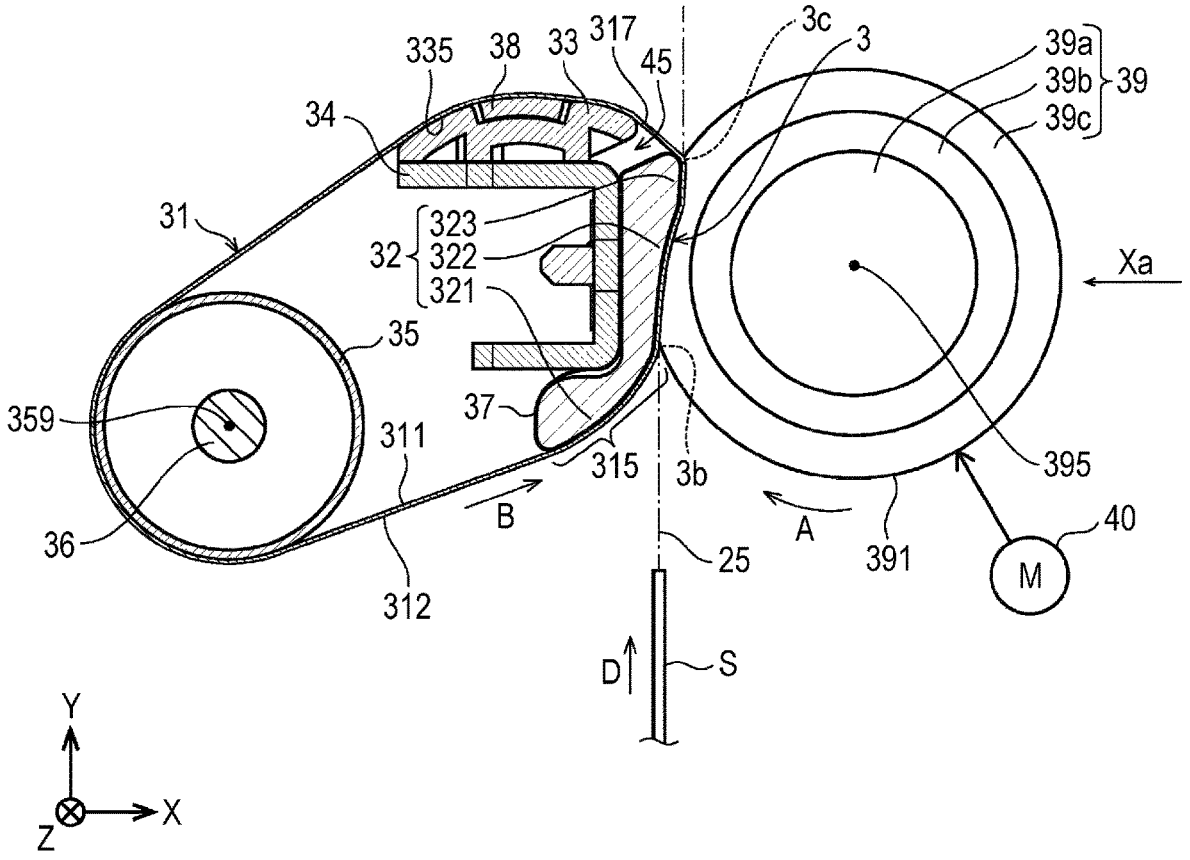
FIG. 2 is a section view illustrating a schematic configuration of a fixing part of the printer.

FIG. 2 is a schematic section view illustrating a configuration of the fixing part 30. Here, in the drawing, the X-axis direction and the Y-axis direction represent the left-right direction and the up-down direction when the printer 1 is viewed from the front side, and the Z-axis direction is a direction orthogonal to both the X axis and the Y axis and corresponds to the depth direction of the printer 1. The drawing is a cross-section view of the fixing part 30 taken along an X-Y plane orthogonal to the Z axis.

As illustrated in the drawing, the fixing part 30 includes an endless belt 31, a fixed pad 32 that is in contact with an inner peripheral surface 311 of the belt 31 via a sliding member 37, a guide member 33 that is in contact with the inner peripheral surface 311 of the belt 31 immediately after passing through the fixing nip 3 to guide the belt 31, a support member 34 that supports the fixed pad 32 and the guide member 33, a heating roller 35 that heats the belt 31, a heater 36 that applies heat to the heating roller 35, a lubricant supply member 38 that applies lubricant on the inner peripheral surface 311 of the belt 31, and a pressurizing roller 39 that presses an outer peripheral surface 312 of the belt 31.

The belt 31 is wound around the fixed pad 32, the heating roller 35, and the guide member 33, and tension is applied when the heating roller 35 is urged in a direction away from the fixed pad 32 by an elastic member such as an unillustrated spring.

The belt 31 is formed by laminating, on a base layer formed from polyimide, stainless steel (SUS), electrocast nickel (Ni), or the like, an elastic layer formed from a material having high heat resistance such as silicone rubber or fluorine rubber, and a release layer to which releasability is imparted, such as a fluorine tube or a fluorine coating, in this order. The outer diameter of the belt 31 can be arbitrarily set, but is desirably within a range of 10 to 100 mm. The thickness of the base layer is desirably in a range of, for example, 5 to 100 μm, the thickness of the elastic layer is desirably in a range of, for example, 10 to 300 μm, and the thickness of the release layer is desirably in a range of, for example, 5 to 100 μm. The inner diameter of the belt 31 is constant at the same value at any position in the Z-axis direction (belt width direction).

The pressurizing roller 39 is formed by laminating, on a hollow core metal 39*a* formed from aluminum, iron, or the like, an elastic layer 39*b* formed from a material having high heat resistance such as silicone rubber or fluorine rubber, and a release layer 39*c* to which releasability is imparted, such as a fluorine tube or a fluorine coating, in this order. The outer diameter of the pressurizing roller 39 can be arbitrarily set, but is desirably within a range of 20 to 100 mm. As the core metal 39*a*, for example, a pipe-shaped core metal having a thickness in a range of 0.1 to 10 mm or a non-circular core metal having an irregular shape such as a three-arrow cross-sectional shape can also be used. In addition, the thickness of the elastic layer 39*b* is desirably in a range of, for example, 1 to 20 mm, and the thickness of the release layer 39*c* is desirably in a range of, for example, 5 to 100 μm.

A shaft center 395 of a rotation shaft of the pressurizing roller 39 is parallel to the Z axis, both axial ends of the pressurizing roller 39 are rotatably supported by a fixed frame (not illustrated: hereinafter, simply referred to as a "frame") constituting a housing of the fixing part 30, and an outer peripheral surface 391 of the pressurizing roller 39 is pressed against the belt 31 by an urging force from an elastic member (not illustrated) such as a spring.

The pressurizing roller 39 is rotationally driven at a predetermined rotational speed in a direction indicated by an arrow A by a rotational driving force of a fixing conveyance motor 40. Due to the rotation of the pressurizing roller 39, the belt 31 is driven to rotate (run) in a direction indicated by an arrow B (belt circulating direction).

The fixed pad 32 and the guide member 33 are arranged side by side along the belt circulating direction, are non-rotary members that do not rotate together with the circulating belt 31, and the Z-axis direction length thereof is slightly larger than the Z-axis direction length (belt width) of the belt 31.

The fixed pad 32 is disposed on the inner peripheral side of the belt 31 at a position opposite to the pressurizing roller 39 located outside the belt 31 with the belt 31 therebetween, and an upstream guide 321, a pressed part 322, and a downstream guide 323 are provided adjacent to each other in this order along the belt circulating direction.

The upstream guide 321 is provided upstream of the pressed part 322 in the belt circulating direction, and guides a belt part 315 of the belt 31, which is located upstream of the fixing nip 3 in the belt circulating direction and located immediately before the fixing nip 3. The upstream guide 321 is located upstream of the fixing nip 3 in the belt circulating direction and does not contribute to the formation of the fixing nip 3.

Here, the fixed pad 32 is one molded product, and the upstream guide 321 is extended from the pressed part 322 to the upstream side in the belt circulating direction. However, if possible, the fixed pad 32 in which the upstream guide 321 and the pressed part 322 are formed of different members can also be used.

The upstream guide 321 is provided with pressure application parts 324 and 325 (FIG. 5) that apply pressure between the upstream guide 321 and the belt 31 that gradually decreases from the edge toward the center of the belt 31 in the width direction (corresponding to the Z-axis direction). The pressure application parts 324 and 325 will be described later. Hereinafter, the width direction of the belt 31 will be referred to as a belt width direction.

The pressed part 322 receives a pressing force from the pressurizing roller 39 via the sliding member 37 present between the pressed part 322 and the inner peripheral surface 311 of the belt 31. The pressurizing roller 39 located on the outer peripheral side of the belt 31 presses the pressed part 322 of the fixed pad 32 located on the inner peripheral side of the belt 31 via the belt 31, thus the outer peripheral surface 391 of the pressurizing roller 39 and the outer peripheral surface 312 of the belt 31 come into pressure contact with each other, and the fixing nip 3 is formed between the belt 31 and the pressurizing roller 39. The upstream end of the fixing nip 3 in the belt circulating direction is 3*b*, and the downstream end of the fixing nip 3 in the belt circulating direction is 3*c*.

The downstream guide 323 guides a belt part 317 of the belt 31 immediately after passing through the fixing nip 3 to the guide member 33 on the downstream side in the belt circulating direction.

As the fixed pad 32, for example, a resin such as polyphenylene sulfide, polyimide, or liquid crystal polymer is used, and it is desirable that the fixed pad 32 has excellent heat resistance. In addition, the fixed pad 32 may be formed from metal such as aluminum or iron, ceramics, or the like, or a composite of these with silicone rubber, fluorine rubber, or the like may be used.

The guide member 33 is disposed at a position that is downstream of the fixed pad 32 and upstream of the heating roller 35 in the belt circulating direction and closer to the fixed pad 32 than to the heating roller 35, which is herein a position in the vicinity of the fixed pad 32 with a space 45 therebetween, and guides the belt part 317 of the belt 31 guided by the downstream guide 323 further downstream in the belt circulating direction. Note that the guide member 33 is present at a position away from the fixing nip 3 in the belt circulating direction, and does not contribute to the formation of the fixing nip 3. The material of the guide member 33 may be the same as that of the fixed pad 32, or may be different resin or metal.

The support member 34 is a member having a U-shaped cross section and formed from metal such as aluminum, iron, or SUS, and fixedly supports the fixed pad 32, the guide member 33, and the sliding member 37.

Figure 3:
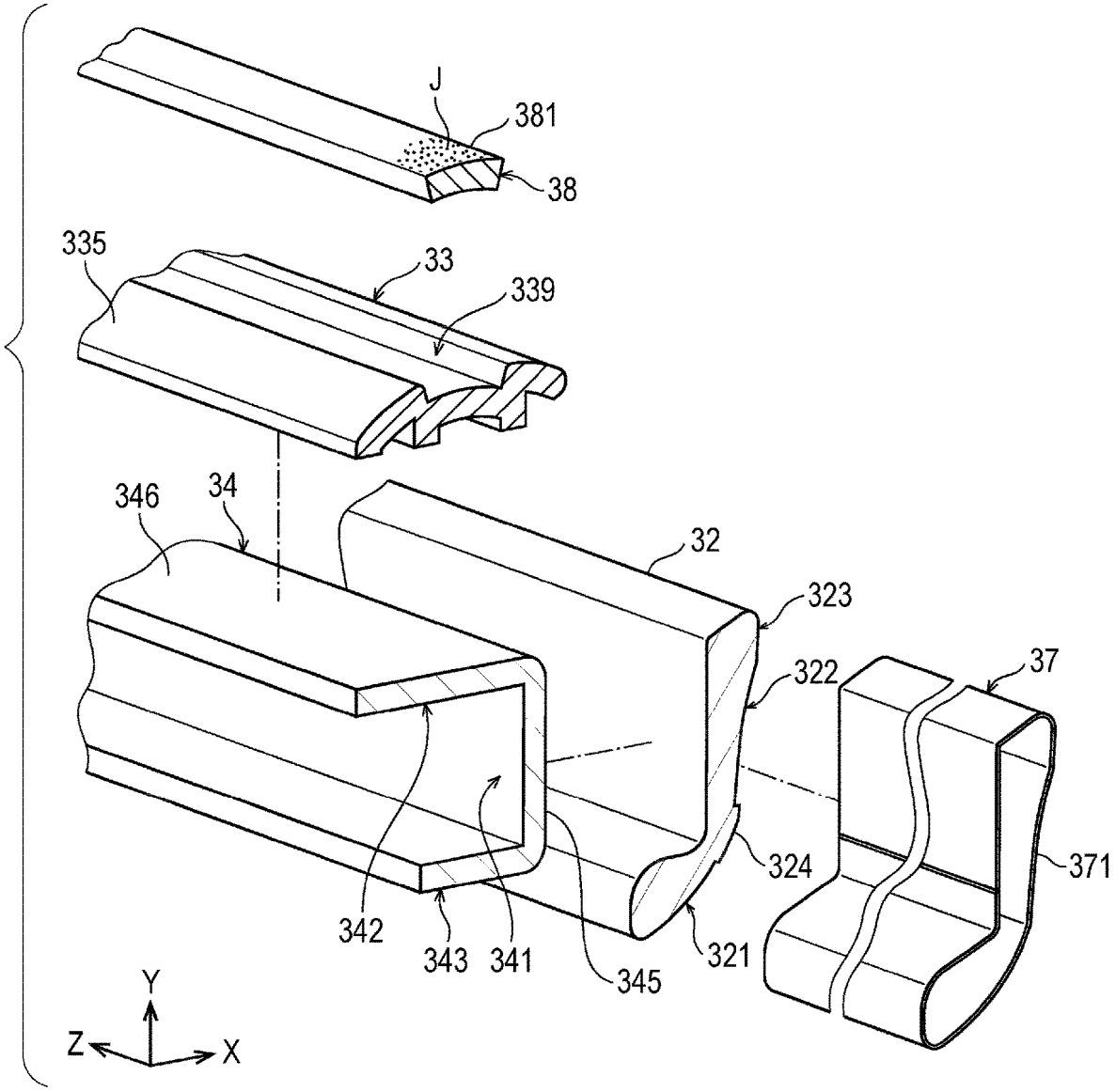
FIG. 3 is a schematic exploded perspective view of a support member, a fixed pad, a guide member, a sliding member, and a lubricant supply member in the fixing part.

FIG. 3 is a schematic exploded perspective view of the support member 34, the fixed pad 32, the guide member 33, the sliding member 37, and the lubricant supply member 38, and does not illustrate the belt 31.

As illustrated in the drawing, the support member 34 has a shape elongated in the Z-axis direction, both ends thereof in the longitudinal direction are fixedly supported by the frame, and includes a center part 341 along the vertical direction, an upper horizontal part 342 extending leftward from an upper end of the center part 341, and a lower horizontal part 343 extending leftward from a lower end of the center part 341.

The fixed pad 32 is fixedly supported on a right side surface 345 of the center part 341 of the support member 34 by adhesion or the like via the sliding member 37, and the guide member 33 is fixedly supported on an upper surface 346 of the upper horizontal part 342 of the support member 34 by adhesion or the like.

The lubricant supply member 38 is elongated in the Z-axis direction, has a length approximately equal to the belt width of the belt 31, and is fitted in a groove 339 along the Z-axis direction provided on a belt guide surface 335 of the guide member 33. The lubricant supply member 38 contains a lubricant J, and an upper surface 381 comes into contact with the inner peripheral surface 311 of the belt 31 to apply the lubricant J on the inner peripheral surface 311 of the belt 31. In addition, the lubricant supply member 38 also has a function of collecting and holding the lubricant J applied on the inner peripheral surface 311 of the belt 31 from the belt 31 that is circulating, and re-applying the held lubricant J on the inner peripheral surface 311 of the belt 31.

For the lubricant supply member 38, a material suitable for holding the lubricant J, for example, a fibrous material such as aramid fiber or fluorine fiber, or a porous material such as silicone sponge is used. Here, an elastically deformable material is used, but the configuration is not limited to this. As the lubricant J, a silicon-based or fluorine-based lubricant having high heat resistance is desirable, but other materials such as fluorine grease may be used. By using grease having high viscosity and containing a solid component, the lubricant easily remains between the belt 31 and the sliding member 37 in the fixing nip 3, and wear can be suppressed for a longer period of time.

The sliding member 37 is a low friction sheet, and is wound around the fixed pad 32 so as to surround the periphery of the fixed pad 32 by about one full circle, and for example, a sheet having a configuration in which a sliding surface (outer surface) including glass cloth as a base material is covered with a fluorine based resin is used therefor.

A surface 371 of the sliding member 37 on the belt 31 side is formed with minute recesses and protrusions, and these irregularities reduce a contact area with the belt 31 and reduces frictional force. The size of the irregularities is arbitrarily set, but the surface roughness Ra of the surface 371 is desirably, for example, within a range of 1 to 50 μm from the viewpoint of the function of holding the lubricant J and the suppression of the image unevenness caused by the irregularities. The sliding member 37 may be a member formed from a material capable of reducing the sliding resistance with respect to the belt 31, and for example, a fluorine fiber woven fabric, a fluorine resin sheet, or a glass coating may be used.

With the sliding member 37 interposed between the belt 31 and the fixed pad 32, the lubricant J applied on the inner peripheral surface 311 of the belt 31 by the lubricant supply member 38 is supplied to the surface 371 of the sliding member 37 via the belt 31, thus the sliding resistance when the belt 31 passes through the fixing nip 3 is reduced, the stability of the circulation of the belt 31 is secured for a long period of time, and the wear of the belt 31 is also reduced.

Returning to FIG. 2, the heating roller 35 is formed of a cylinder formed from metal such as aluminum, SUS, or the like, a shaft center 359 of the rotation shaft thereof is parallel to the Z-axis direction, and both axial ends of the heating roller 35 are rotatably supported by the frame. The outer diameter of heating roller 35 is arbitrarily set, but is desirably within a range of 10 to 100 mm, and the thickness thereof is desirably within a range of 0.1 to 5 mm.

The heater 36 as a heat source is a halogen heater elongated along the axial direction of the heating roller 35, is inserted into the inner space of the cylindrical heating roller 35, and applies heat generated by power supply from an unillustrated power source to the heating roller 35. It is desirable that the inner peripheral surface of the heating roller 35 be black so that heat is efficiently transferred from the halogen heater to the heating roller 35.

The present invention is not limited to the method of heating the belt 31 by the heat of the halogen heater. For example, the heater 36 may be another type of heater such as an infrared heater or an electric heating wire. In addition, any configuration may be used as long as the belt 31 is heated, and for example, a resistance heating method in which the belt 31 is formed of a heating resistor that generates heat by power supply can also be used. In this configuration, energization of the heating resistor heats the belt 31. In addition, it is also possible to use a so-called induction heating (IH) method in which the belt 31 generates heat by electromagnetic induction.

In the above configuration, when the pressurizing roller 39 is rotationally driven in the arrow A direction, the belt 31 receives the rotational driving force and travels in the arrow B direction in accordance with the rotational driving force. This traveling direction is the belt circulating direction. When the heater 36 is energized while the pressurizing roller 39 is rotationally driven, the heat generated from the heater 36 is transferred from the heating roller 35 to the belt 31, and reaches the fixing nip 3 by the circulation of the belt 31. As a result, the heat of the heater 36 is supplied to the fixing nip 3.

In the present embodiment, although not illustrated, a sensor that detects the surface temperature of the belt 31 and transmits the detection result to an unillustrated control unit is disposed in the fixing part 30. The control unit performs temperature adjustment control to switch on and off the heater 36 so that the temperature of the fixing nip 3 is maintained at a fixing temperature (for example, 170° C.) necessary for fixing on the basis of the temperature detected by the sensor.

By this temperature control, the temperature of the fixing nip 3 is stabilized at the fixing temperature, and when the recording sheet S conveyed through the conveyance path 25 passes through the fixing nip 3, the unfixed image on the recording sheet S is heated and melted and pressed to be fixed on the recording sheet S.

(3) Configuration of Fixed Pad

Figure 4:
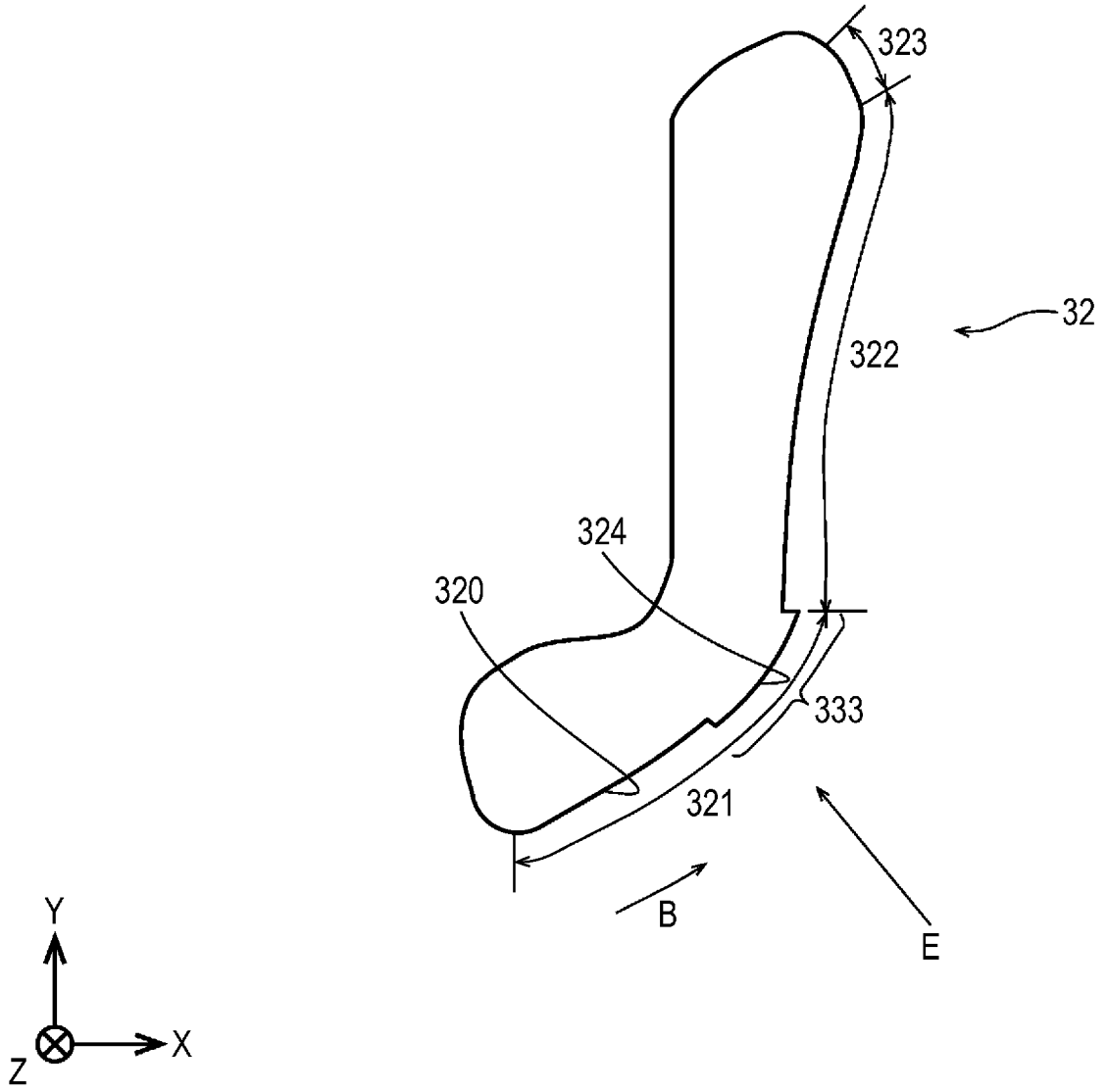
FIG. 4 is a schematic diagram illustrating a configuration of a fixed pad.
Figure 5:
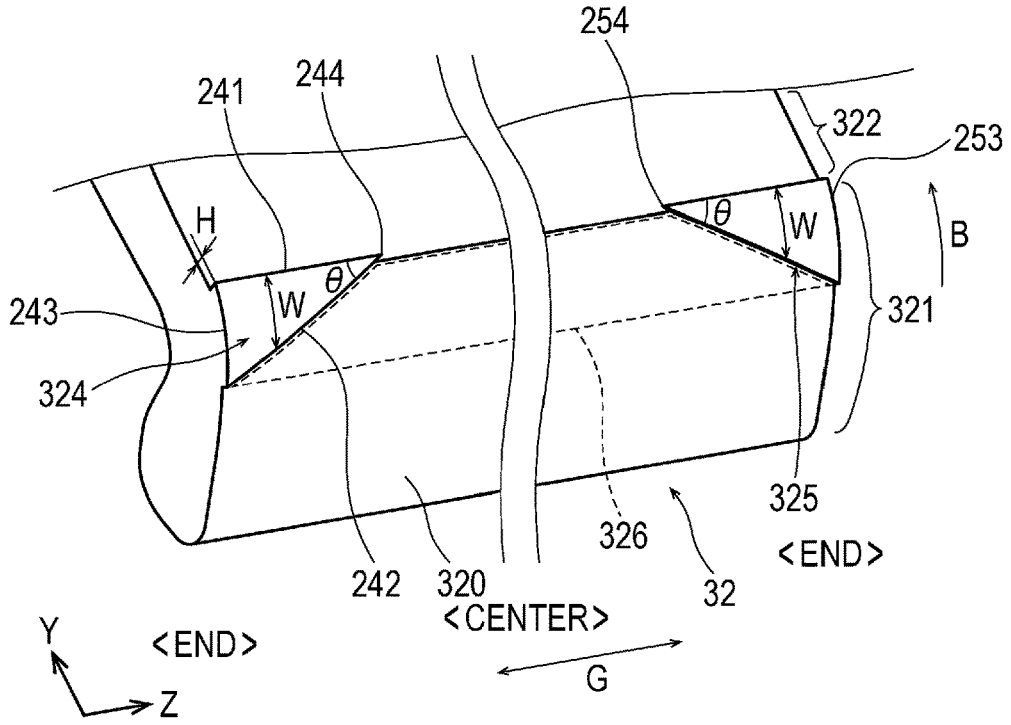
FIG. 5 is a schematic perspective view when an upstream guide of the fixed pad is viewed from a direction indicated by an arrow E in FIG. 4.
Figure 6:
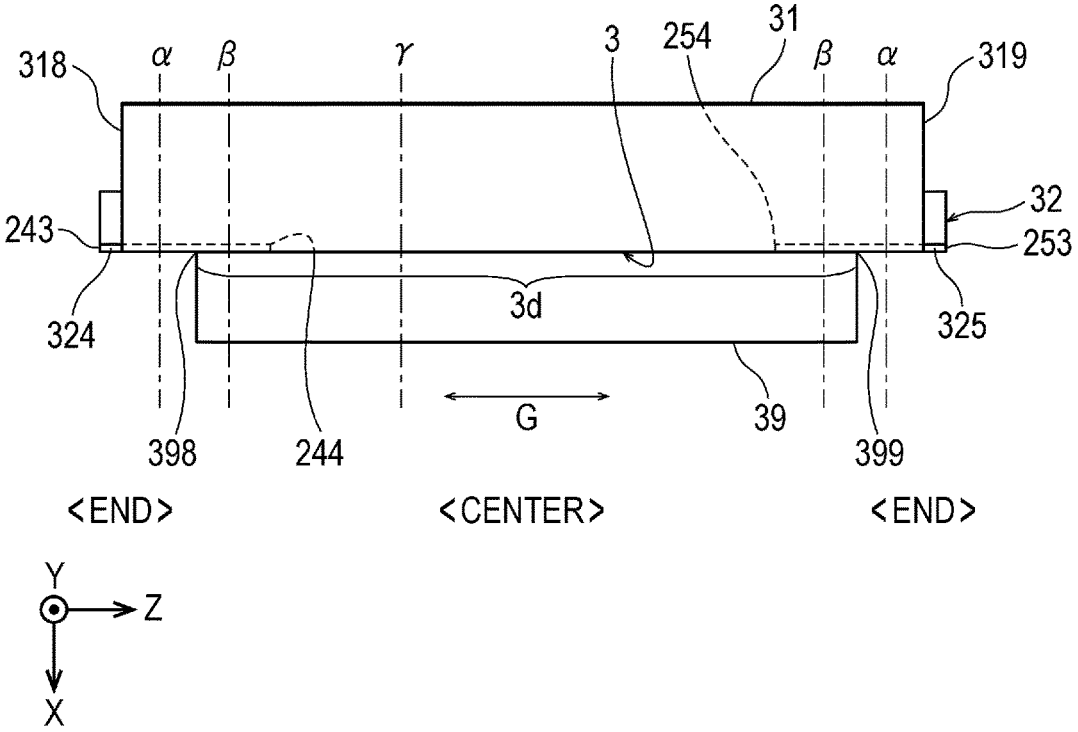
FIG. 6 is a schematic plan view of a belt, a fixed pad, and a pressurizing roller as viewed from above.

FIG. 4 is a schematic diagram illustrating a configuration of the fixed pad 32, FIG. 5 is a schematic perspective view of the upstream guide 321 of the fixed pad 32 as viewed from a direction indicated by an arrow E in FIG. 4, FIG. 6 is a schematic plan view of the belt 31, the fixed pad 32, and the pressurizing roller 39 as viewed from above, and illustration of members other than the belt 31, the fixed pad 32, and the pressurizing roller 39 is omitted.

As illustrated in FIGS. 4 and 5, the upstream guide 321 of the fixed pad 32 has a guide surface 320 that is in contact with the inner peripheral surface 311 of the belt 31 via the sliding member 37, and convex surface parts (pressure application parts) 324 and 325 that protrude by a predetermined amount H toward the inner peripheral surface 311 of the belt 31 are provided at end parts that are downstream ends in the belt circulating direction (arrow B direction) and ends in the belt width direction (arrow G direction).

Figure 7:
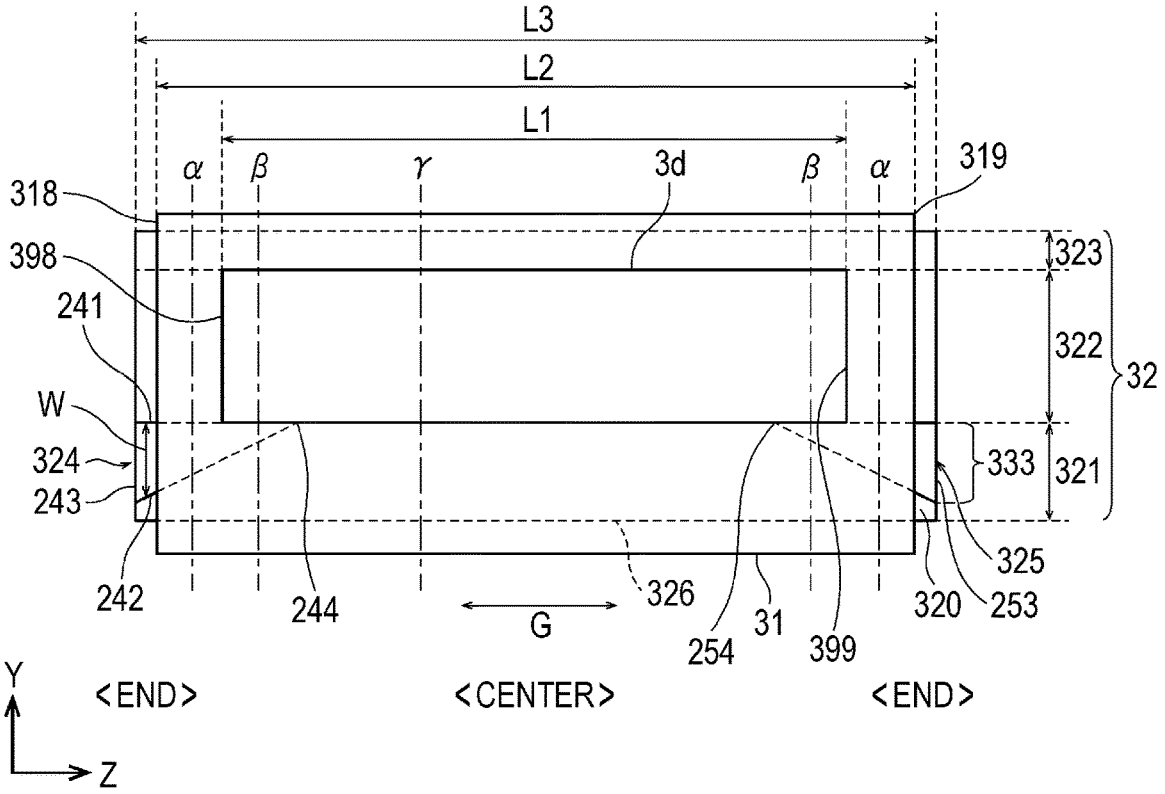
FIG. 7 is a schematic side view of the belt and the fixed pad as viewed through the pressurizing roller from an arrow Xa direction in FIG. 2.

Here, since the upstream guide 321 and the pressed part 322 for forming the fixing nip 3 are adjacent in this order in the belt circulating direction, the positions of the convex surface parts 324 and 325 provided in the upstream guide 321 in the belt circulating direction can be said to be in a region immediately before reaching the fixing nip 3 (reference numeral 333 in FIGS. 4 and 7). Hereinafter, these positions will be referred to as positions immediately before the fixing nip 3.

When a part (broken line) 326 close to the center in the belt width direction positioned between the convex surface parts 324 and 325 located on both end sides in the belt width direction is defined as a center part, the center part 326 is a region other than the convex surface parts 324 and 325 on the guide surface 320 of the upstream guide 321, and is recessed with respect to the convex surface parts 324 and 325.

Therefore, the guide surfaces 320 of the convex surface parts 324 and 325 can be said to be surfaces in which the height (height in the thickness direction) in the direction approaching the inner peripheral surface 311 of the belt 31 is increased by a predetermined amount H with respect to the guide surface 320 of the center part 326. Here, the predetermined amount H is a value within a range of 0.1 to 0.5 mm. The thickness of the convex surface parts 324 and 325 is larger than that of the center part 326 so that the convex surface parts 324 and 325 are higher than the center part 326 by the predetermined amount H with respect to the center part 326. Note that, depending on the apparatus configuration, the predetermined amount H may be set to a value within a range different from the above.

As illustrated in FIG. 5, the convex surface part 324 has a right triangle shape in plan view, and has a side 241 (first side) parallel to the belt width direction, an oblique side 242 (second side), and a side 243 along the belt circulating direction. The angle formed by the side 241 and the side 243 is 90°, and the angle θ formed by the side 241 and the oblique side 242 is 30° in this embodiment.

The convex surface part 324 is formed in an orientation in which the side 243 faces the end side in the belt width direction and an apex 244 of the corner of 30° faces the central side in the belt width direction. That is, the side 243 is the outermost end in the belt width direction (the base end on the end side in the belt width direction), and the apex 244 is the end farthest from the end in the belt width direction, that is, the end on the central side in the belt width direction. The side 243 will be referred to as a base end of the convex surface part 324 in the belt width direction, and the apex 244 will be referred to as a tip end of the convex surface part 324 in the belt width direction.

A length (width) W of the convex surface part 324 in the belt circulating direction corresponds to an interval between the side 241 and the oblique side 242, and the convex surface part 324 has a tapered shape in which the length W gradually decreases from a base end 243 in the belt width direction which is on the end side in the belt width direction toward a tip end 244 in the belt width direction which is on the central side in the belt width direction.

The convex surface part 325 has a right triangle shape in plan view that has basically the same shape and the same height as the convex surface part 324, and has a tapered shape in which the length W in the belt circulating direction gradually decreases from a base end 253 in the belt width direction toward a tip end 254 in the belt width direction as illustrated in FIG. 5.

The positional relationship among the convex surface parts 324 and 325, the belt 31, and the pressurizing roller 39 in the belt width direction is illustrated in FIG. 6. That is, on one end side in the belt width direction (left end side in the drawing), the base end 243 of the convex surface part 324 in the belt width direction, one end (edge) 318 of the belt 31 in the belt width direction, one end 398 of the pressurizing roller 39 in the axial direction, and the tip end 244 of the convex surface part 324 in the belt width direction are arranged in this order in a direction (arrow Z direction) from the one end in the belt width direction toward the center.

Similarly, on the other end side in the belt width direction (right end side in the drawing), the base end 253 of the convex surface part 325 in the belt width direction, the other end (edge) 319 of the belt 31 in the belt width direction, the other end 399 of the pressurizing roller 39 in the axial direction, and the tip end 254 of the convex surface part 325 in the belt width direction are arranged in this order in a direction (direction opposite to the arrow Z) from the other end in the belt width direction toward the center.

Here, an area **3*d* where the pressurizing roller 39 and the belt 31 are in contact with each other indicates a nip formation area of the fixing nip 3, and axial ends 398 and 399 of the pressurizing roller 39 are equal to the edges of the nip formation area 3*d*** in the belt width direction.

From FIG. 6, the base ends 243 and 253 of the convex surface parts 324 and 325 in the belt width direction protrude to the outside of the belt 31 in the belt width direction.

Further, the tip end 244 of the convex surface part 324 in the belt width direction extends to a position closer to the center of the nip formation area **3*d* (the axial center of the pressurizing roller 39) than one edge (one end of the pressurizing roller 39) 398 of the nip formation area 3*d*** in the belt width direction.

Similarly, the tip end 254 of the convex surface part 325 in the belt width direction extends to a position closer to the center of the nip formation area **3*d* (the axial center of the pressurizing roller 39) than the other edge (the other end of the pressurizing roller 39) 399 of the nip formation area 3*d*** in the belt width direction.

FIG. 7 is a schematic side view of the belt 31 and the fixed pad 32 as viewed through the pressurizing roller 39 from an arrow Xa direction in FIG. 2, and a rectangular area indicated by a solid line **3*d*** indicates a nip formation area.

As illustrated in FIG. 7, when the length of the nip formation area **3*d* in the belt width direction is L1, the length of the belt 31 in the belt width direction is L2, and the length of the fixed pad 32 in the belt width direction is L3, a magnitude relationship of L1<L2<L3 is established. The belt width direction length L1 of the nip formation area 3*d* is equal to the axial length of the pressurizing roller 39**.

Figure 8:
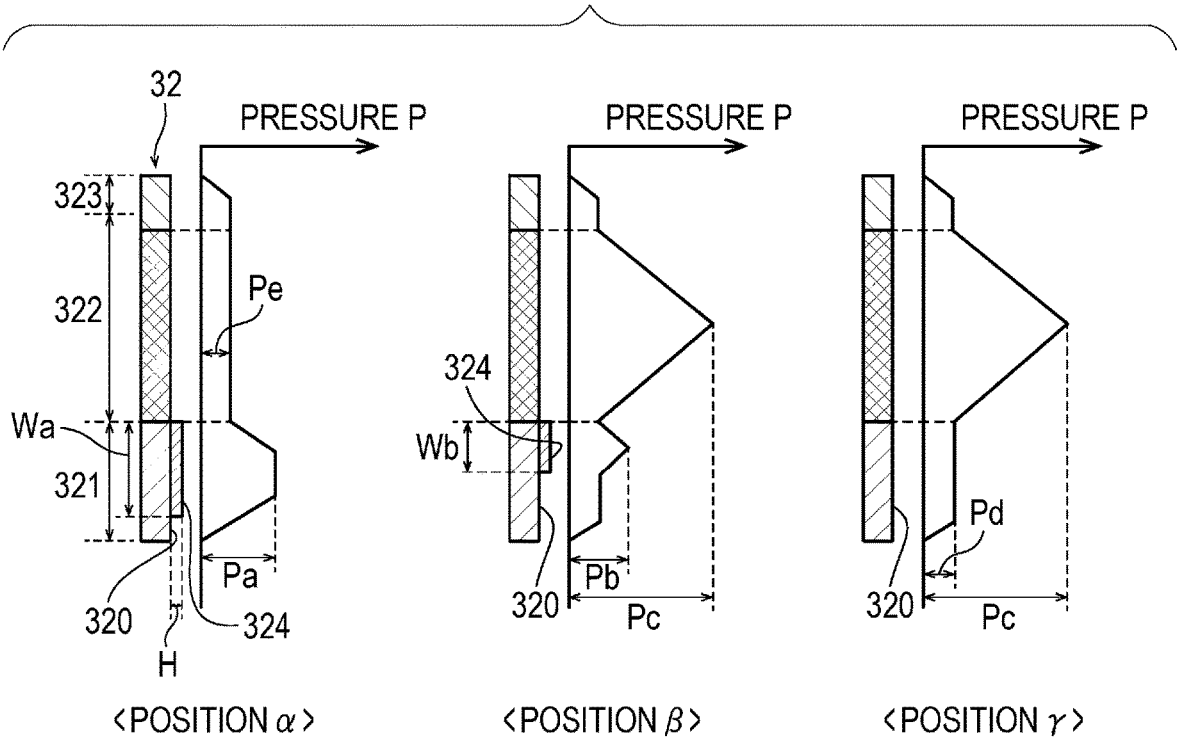
FIG. 8 is a schematic diagram illustrating a magnitude relationship of pressure generated between the belt and the fixed pad at three different positions in the belt width direction in an embodiment.

FIG. 8 is a schematic diagram illustrating a magnitude relationship of pressure generated between the belt 31 and the fixed pad 32 at three different positions α, β, and γ in the belt width direction in a normal state where the pressurizing roller 39 presses the fixed pad 32 via the belt 31 with a normal pressure at the time of printing. This pressure corresponds to a value obtained by dividing a pressing force acting in a direction perpendicular to the inner peripheral surface 311 of the belt 31 by a unit area.

Here, the position α is a position outside the nip formation area **3*d*** in the belt width direction.

The position β is a position in the nip formation area 3*d* and in an area between the one end 398 of the nip formation area 3*d* and the tip end 244 of the convex surface part 324 in the belt width direction or in an area between the other end 399 of the nip formation area 3*d* and the tip end 254 of the convex surface part 325 in the belt width direction.

The position γ is a position in the nip formation area 3*d* in the belt width direction and closer to the center than the tip ends 244 and 254 of the convex surface part 324 in the belt width direction.

As illustrated in FIG. 8, at the position α, the pressure P between the belt 31 and the upstream guide 321 is Pa, and the pressure P between the pressed part 322 and the belt 31 is Pe.

Since the position α is out of the nip formation area 3*d*, the pressures Pa and Pe are generated not by the pressing force of the pressurizing roller 39 but by the tension acting on the belt 31 stretched by the fixed pad 32, the heating roller 35, and the guide member 33.

As described above, the inner diameter of the belt 31 is the same at any position in the belt width direction. Therefore, when a part where the convex surface parts 324 and 325 are provided on the upstream guide 321 (end in the belt width direction: position α) and a part where the convex surface parts 324 and 325 are not provided (center part in the belt width direction: position γ) are compared with each other, the force by which the convex surface parts 324 and 325 push the belt 31 from the inner peripheral surface side to the outer peripheral surface side is larger by an amount corresponding to the thickness of the convex surface parts 324 and 325 at the ends where the convex surface parts 324 and 325 are provided than at the center part where the convex surface parts 324 and 325 are not provided. Since the pressing force is larger, the tension acting on the belt 31 becomes, as a reaction thereof, higher than in the center part where the convex surface parts 324 and 325 are not provided, and the increase in the tension is reflected on the pressure Pa with respect to the pressure P.

Since the pressed part 322 is not provided with the convex surface parts 324 and 325 is a concave curved surface unlike the guide 321 which is a convex curved surface, the pressure Pe is considerably smaller than the pressure Pa of the guide 321.

At the position β, the pressure P is Pb (<Pa), and the pressure P between the belt 31 and the pressed part 322 is Pc (>Pb). Since the position β is in the nip formation area 3*d*, the pressure Pc (nip pressure) is considerably large due to the pressing force of the pressurizing roller 39. In the drawing, for convenience of illustration, the magnitude Pc of the pressure P is shown as about 2 times of Pb, but is actually about 10 times or more. When the nip pressure is too high, the lubricant J may not enter between the belt 31 and the fixed pad 32 at all, and therefore a nip pressure suitable for fixing is set in advance by an experiment or the like within a range in which a necessary amount of the lubricant J can enter between the belt 31 and the fixed pad 32.

In contrast, the pressure Pb at the position is smaller than the pressure Pa at the position α. This is because a length Wb of the convex surface parts 324 and 325 in the belt circulating direction at the position is smaller than a length Wa of the convex surface parts 324 and 325 in the belt circulating direction at the position α. That is, at the position β, similarly to the position α, the pressing force of the pressurizing roller 39 does not act at the position immediately before the fixing nip 3, and thus, the magnitude of the tension acting on the belt 31 affects the magnitude of the pressure Pb. The thickness of the convex surface parts 324 and 325 is the same at any position in the belt width direction as described above, but as the length W in the belt circulating direction is smaller, the length in the belt circulating direction of the region where the belt 31 is pressed from the inner peripheral surface side to the outer peripheral surface side is also smaller, and accordingly, the force by which the convex surface parts 324 and 325 press the belt 31 from the inner peripheral surface side to the outer peripheral surface side is reduced. As the pressing force decreases, the tension acting on the belt 31 decreases, and as the tension decreases, the pressure Pb at the position β becomes smaller than the pressure Pa at the position α.

Although the pressure P is not illustrated between the position α and the position β, the convex surface parts 324 and 325 have a right triangle shape in plan view as illustrated in FIG. 7, and the convex surface parts 324 and 325 are formed in a shape in which the belt circulating direction length W of the convex surface parts 324 and 325 gradually decreases from the end side toward the central side in the belt width direction. As the length W of the convex surface parts 324 and 325 gradually decreases, the pressure P between the upstream guide 321 and the belt 31 has a pressure distribution that gradually decreases from the edge of the belt 31 in the belt width direction toward the center (from the end side toward the central side in the belt width direction) as indicated by the solid line graph of FIG. 9. This pressure distribution is equivalent to a relationship in which, in the region where the belt 31 is pressed by the convex surface parts 324 and 325, the pressure P is higher on the end side (outer side) than on the central side (inner side) even when comparing the positions of any arbitrary two points different from each other in the belt width direction.

For example, the magnitude of the pressure P is desirably within a range of 1 to 200 kPa. When the pressure P is less than 1 kPa, the contact state between the belt 31 and the upstream guide 321 tends to be unstable, and when a part having a strong pressing force and a part having a weak pressing force are generated between one end and the other end in the belt width direction, temperature unevenness in the belt width direction may occur, and image unevenness after fixing may occur. In contrast, when the pressure P is more than 200 kPa, the pressure becomes too high so that it becomes difficult for the lubricant J to enter between the belt 31 and the upstream guide 321, wear of the belt 31 and the sliding member 37 is prompted, and durability may deteriorate. Note that, depending on the device configuration, the magnitude of the pressure P may be set to a value within a range different from the above.

Returning to FIG. 8, at the position γ (center part in the belt width direction), the pressure P between the belt 31 and the upstream guide 321 is Pd (<Pb), and the pressure P between the belt 31 and the pressed part 322 is Pc. Since the position γ is in the nip formation area 3*d* similarly to the position β, the pressure Pc of the pressed part 322 is a nip pressure Pc having the same magnitude as in the position β.

The pressure Pd between the belt 31 and the upstream guide 321 is considerably small. This is because the position γ is in the region of the center part where the convex surface parts 324 and 325 are not provided, and thus the tension acting on the belt 31 is lower than in the end region where the convex surface parts 324 and 325 are provided.

On the guide surface 320 of the upstream guide 321, the pressure P in the central region (region not provided with the convex surface parts 324 and 325: 326 in FIG. 5) interposed between the convex surface parts 324 and 325 is approximately equal to Pd (>0) at any position in the belt width direction.

That is, at the position immediately before the fixing nip 3, a predetermined pressing force is applied between the guide surface 320 of the upstream guide 321 and the belt 31 by the tension of the belt 31 at any position in the entire area of the belt 31 from one end to the other end in the belt width direction. Due to the action of the pressing force, the entire area from one end 318 to the other end 319 in the belt width direction of the belt 31 is in contact with the upstream guide 321 via the sliding member 37 at the position immediately before the fixing nip 3.

As a result, for example, in a configuration in which a part in contact with the inner peripheral surface 311 of the belt 31 and a part not in contact with the inner peripheral surface 311 of the belt 31 are alternately provided as in a comb-teeth shaped guide, occurrence of temperature unevenness in the belt width direction caused by heat of the belt 31 dissipating at the part in contact and heat of the belt 31 not dissipating at the part not in contact is prevented. The magnitude relationship between the magnitudes Pe and Pd of the pressure may be arbitrarily set, and Pe<Pd may be set or Pe and Pd may be approximately the same.

Figure 10:
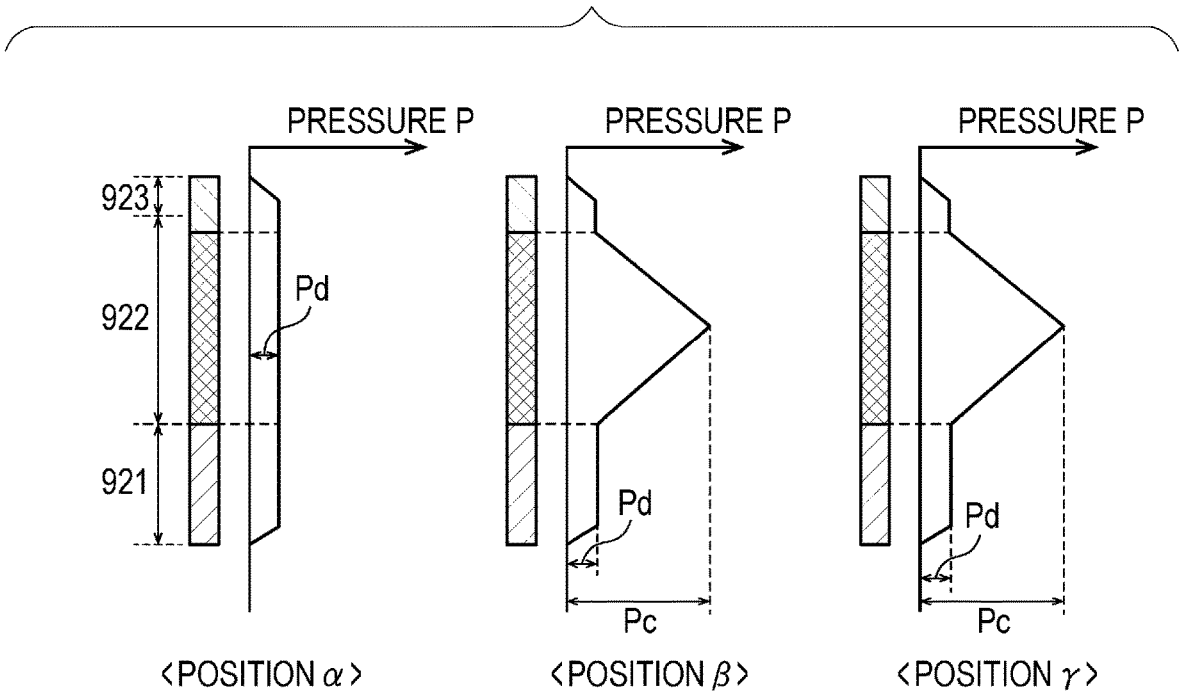
FIG. 10 is a schematic diagram illustrating a magnitude relationship of pressure generated between the belt and the fixed pad at three different positions in the belt width direction in a comparative example.

Here, in a case where the configuration without the convex surface parts 324 and 325 is a configuration (comparative example) equivalent to a conventional configuration, the magnitudes of the pressure P at the positions α, β, and γ are shown in the schematic diagram of FIG. 10. An upstream guide not provided with the convex surface parts 324 and 325 is indicated by 921, and a pressed part 922 and a downstream guide 923 are basically the same as the pressed part 322 and the downstream guide 323 described above.

As illustrated in FIG. 10, in the comparative example, the magnitude of the pressure P of the pressed part 922 and the downstream guide 923 is approximately equal to the magnitude of the pressure P illustrated in FIG. 8. In contrast, since the upstream guide 921 does not have the convex surface parts 324 and 325, the pressure P between the belt 31 and the upstream guide 921 is constant at Pd at any of the positions α, β, and γ. The same applies to positions other than the positions α and β, and the pressure is substantially constant at Pd at any position in the entire region from one end to the other end in the belt width direction (graph of a broken line in FIG. 9).

How the lubricant J flows along with the circulation of the belt 31 will be described with reference to FIGS. 11A and 11B for a configuration (example) having a pressure distribution in which the pressure gradually decreases from the edge toward the center in the belt width direction of the belt 31 illustrated in FIGS. 7 and 8 and a configuration (comparative example) corresponding to a conventional configuration having a pressure distribution in which the pressure is constant in the belt width direction illustrated in FIG. 10.

Figure 11A:
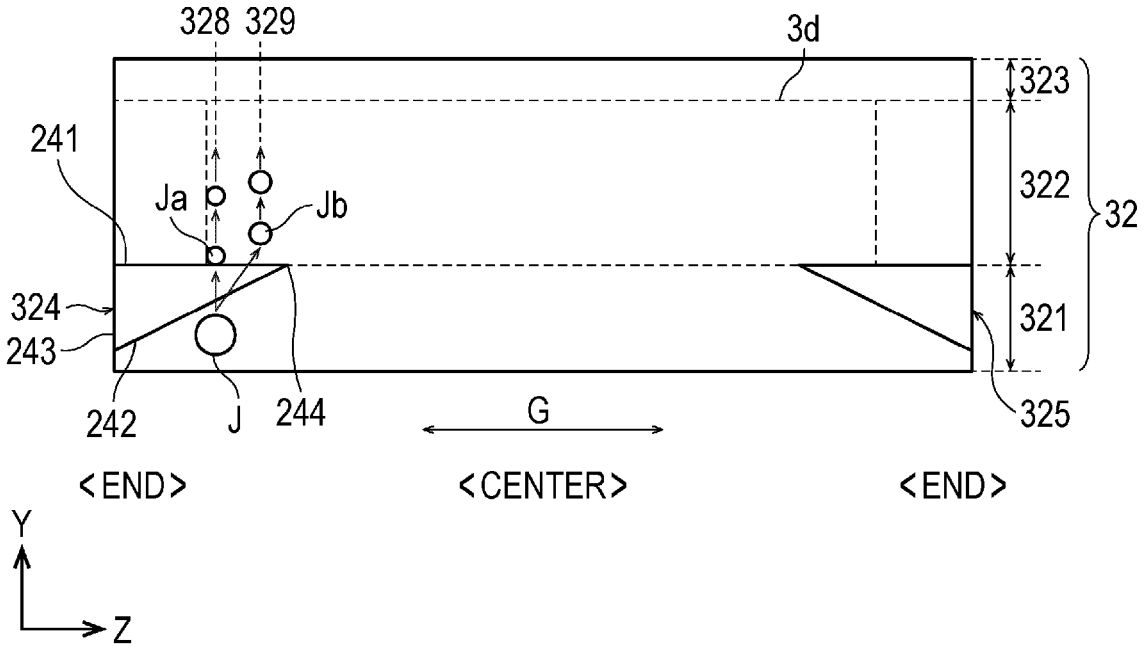
FIG. 11A is a schematic diagram for describing how a lubricant flows in accordance with circulation of the belt in the embodiment.
Figure 11B:
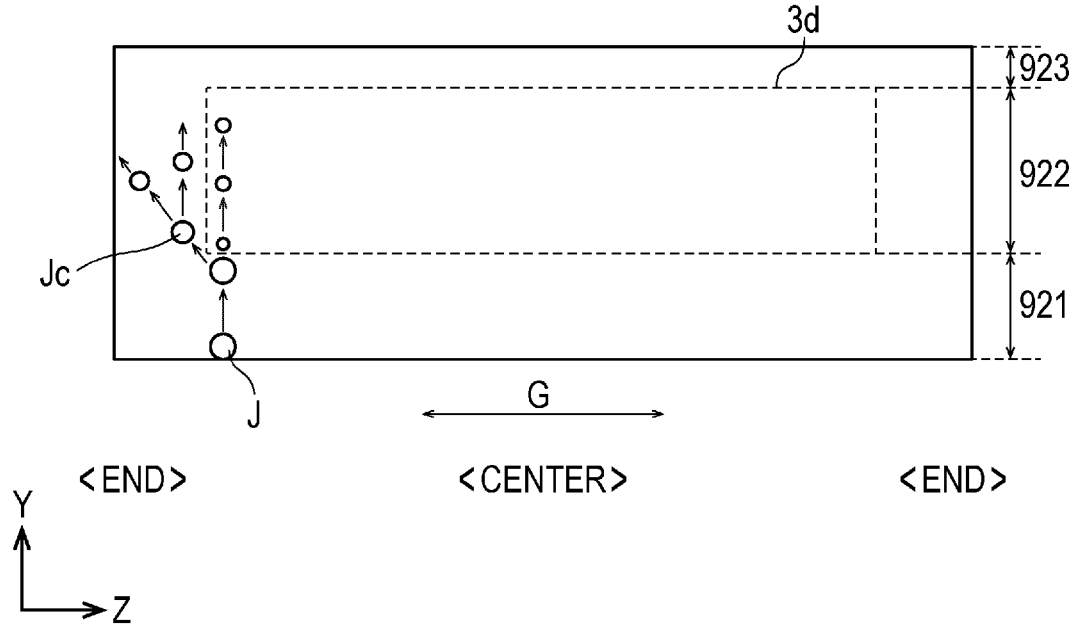
FIG. 11B is a schematic diagram for describing a flow of the lubricant in the comparative example.

Here, FIG. 11A illustrating the example is a schematic side view of the fixed pad 32 as viewed through the pressurizing roller 39, the belt 31, and the sliding member 37 from the arrow Xa direction of FIG. 2, and schematically illustrates a state in which the lubricant J indicated by a circle applied on the inner peripheral surface 311 of the belt 31 enters between the upstream guide 321 of the fixed pad 32 and the belt 31 in accordance with the circulation of the belt 31. In FIG. 2, the direction from the bottom to the top corresponds to the belt circulating direction.

As shown in the example, when the lubricant J reaches the convex surface part 324 of the upstream guide 321 at a position 328 in the belt width direction, a part Ja of the lubricant J directly passes between the convex surface part 324 and the belt 31 along the belt circulating direction (direction from bottom to top) and enters the nip formation area 3*d*, but a remaining part Jb of the lubricant J advances in a direction slightly inclined obliquely toward the center in the belt width direction with respect to the belt circulating direction, passes between the convex surface part 324 and the belt 31, and enters the nip formation area 3*d* at a position 329 closer to the center in the belt width direction than the position 328.

Figure 9:
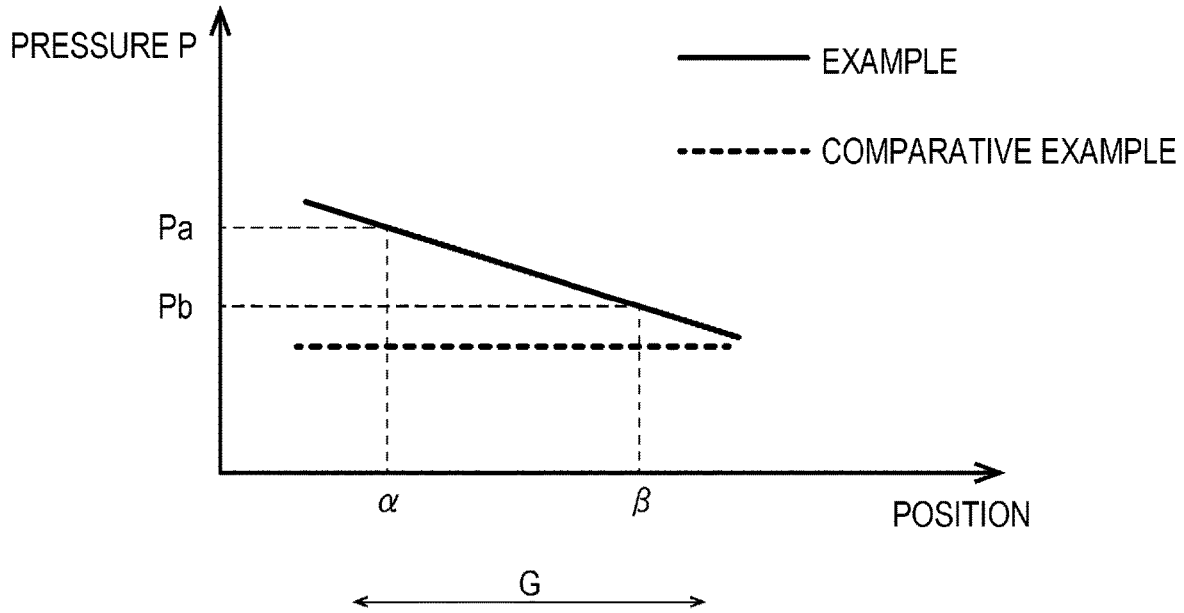
FIG. 9 is a graph illustrating a pressure distribution between the upstream guide and the belt.

This occurs due to the pressure distribution illustrated in FIG. 9 described above, and this occurs because the lubricant J passes between the belt 31 and the convex surface part 324 more easily in the position 329 where the pressure P between the belt 31 and the convex surface part 324 is lower than in the position 328 where the pressure P between the belt 31 and the convex surface part 324 is higher. Due to the pressure distribution illustrated in FIG. 9, that is, the pressure distribution in which the pressure P between the belt 31 and the convex surface part 324 gradually decreases from the edge 318 of the belt 31 in the belt width direction toward the center, the lubricant J present at the end in the belt width direction at the position immediately before the fixing nip 3 is conveyed toward the center in the belt width direction and enters the nip formation area 3*d*. Although the flow of the lubricant J is not illustrated for the convex surface part 325, the lubricant J is conveyed from the edge 319 in the belt width direction toward the center similarly to the convex surface part 324. Although the lubricant J present in the center part in the belt width direction is not illustrated, this lubricant J enters the nip formation area 3*d* as it is.

In contrast, in the comparative example, the upstream guide 921 is not provided with the convex surface parts 324 and 325, and the pressure P between the belt 31 and the upstream guide 921 has the same magnitude over the entire region from one end to the other end in the belt width direction at the position immediately before the fixing nip 3.

Therefore, a part Jc of the lubricant J that has reached the nip formation area 3*d* that is in high pressure at the ends in the belt width direction cannot pass through the nip formation area 3*d* and escapes in the direction toward the edge in the belt width direction (the left direction in the drawing), and eventually leaks out of the belt 31 from the edge of the belt 31.

In the example, the convex surface parts 324 and 325 provided at both ends of the upstream guide 321 in the belt width direction at the position immediately before the fixing nip 3 cause the lubricant J present at the ends in the belt width direction to be conveyed toward the center in the belt width direction and then pass through the nip formation area 3*d*, so that it is possible to prevent the lubricant J present at the ends in the belt width direction from leaking out of the belt 31 as in the comparative example.

Since the lubricant J does not leak out of the belt 31, the amount of the lubricant J on the inner peripheral surface 311 of the belt 31 can be stably maintained, and an increase in frictional resistance between the belt 31 and the fixed pad 32 via the sliding member 37 can be prevented. By preventing the increase in the frictional resistance as described above, it is possible to prevent the progress of wear of the belt 31 from being accelerated, prevent an increase in torque for driving the belt 31, maintain smooth rotation of the belt 31 and the pressurizing roller 39 for a long period of time, and prevent deterioration in the conveyance performance of the recording sheet S.

Since the convex surface parts 324 and 325 are provided only at both ends in the belt width direction, the lubricant J can be returned from the ends in the belt width direction to the center while suppressing the sliding resistance with the inner peripheral surface 311 of the belt 31. Further, the convex surface parts 324 and 325 are formed in such shapes that the length J thereof in the belt circulating direction gradually decreases from the edge of the belt 31 toward the center in the belt width direction. As a result, the area where the convex surface parts 324 and 325 are in contact with the inner peripheral surface 311 of the belt 31 decreases toward the center in the belt width direction, and sliding resistance with the inner peripheral surface 311 of the belt 31 can be suppressed accordingly.

Modification Example

Although the present disclosure has been described above based on an embodiment, it is needless to say that the present disclosure is not limited to the above-described embodiment, and the following modification examples can be considered.

(1) Although the angle θ of the tip ends 244 in the belt width direction of the convex surface parts 324 and 325 is set to 30° in the above embodiment, the configuration is not limited to this. The angle may be any angle as long as the above-described pressure distribution necessary for returning the lubricant J from the ends in the belt width direction to the center can be generated. When the angle θ is too large, the areas of the convex surface parts 324 and 325 increase, and the sliding resistance with the belt 31 increases. Conversely, when the angle θ is too small, it becomes difficult to secure the pressure distribution described above. An angle in a range suitable from the viewpoint of both the sliding resistance with the belt 31 and the securing of the pressure distribution is determined in advance from an experiment or the like.

(2) Although the convex surface parts 324 and 325 of the upstream guide 321 are set to have a right triangle shape in plan view in the above embodiment, the configuration is not limited to this. Any shape may be used as long as the above-described pressure distribution can be generated.

Figure 12:
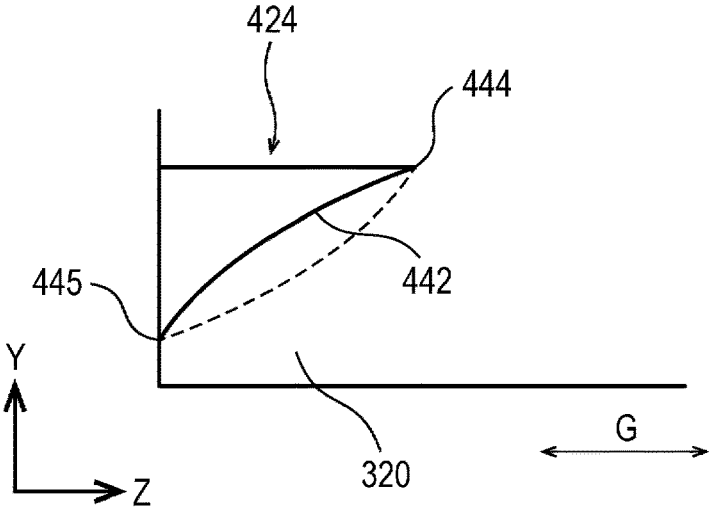
FIG. 12 is a diagram illustrating a configuration of a convex surface part according to a modification example.

For example, a convex surface part 424 having a shape illustrated in FIG. 12 in plan view may also be provided. The convex surface part 424 has a tapered shape in which an edge 442 connecting a tip end 444 in the belt width direction and an upstream end 445 in the belt circulating direction forms a convex arc shape (solid line) in the belt circulating direction.

Such an arc-shaped edge 442 can also be employed as long as the above-described pressure distribution can be generated. In addition, the edge 442 may be formed in an arc shape that is convex in a direction opposite to the belt circulating direction as indicated by a broken line.

Figure 13A:
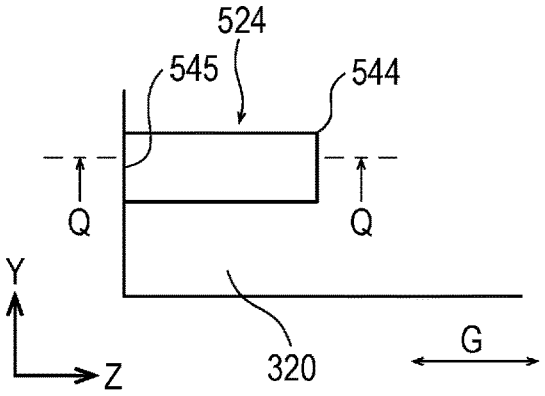
FIGS. 13A and 13B are diagrams illustrating a configuration of another convex surface part according to a modification example.
Figure 13B:
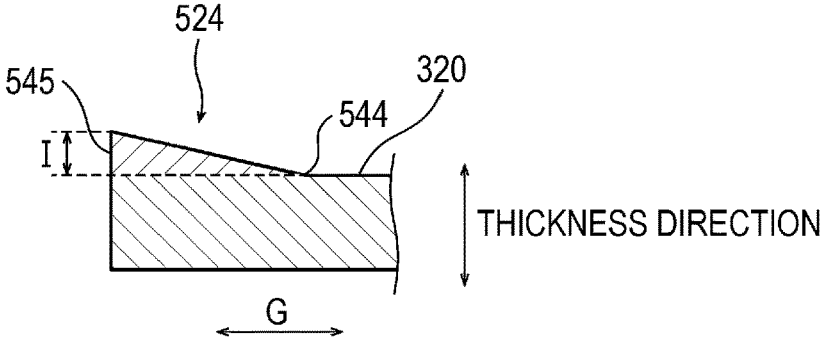

Further, a convex surface part 524 having a configuration illustrated in FIGS. 13A and 13B may be used. FIG. 13A is a schematic diagram illustrating the convex surface part 524 in plan view, and FIG. 13B is a section view taken along a line Q-Q of FIG. 13A. As illustrated in FIG. 13A, the convex surface part 524 has a rectangular shape in plan view, and as illustrated in FIG. 13B, the convex surface part 524 has a shape in which a height I in the thickness direction (direction approaching the belt 31) gradually decreases from a base end 545 in the belt width direction (arrow G direction) toward a tip end 544 in the belt width direction. This gradual decrease in the height I generates the pressure distribution described above. Although only the convex surface part on one end side in the belt width direction has been described above, the convex surface part on the other end side in the belt width direction may have the same shape.

(3) Although a configuration example in which the tip ends 244 and 254 in the belt width direction of the convex surface parts 324 and 325 of the upstream guide 321 are located closer to the center than the one end (edge) 398 and the other end (edge) 399 of the nip formation area 3*d* in the belt width direction as illustrated in FIG. 7 has been described in the above embodiment, the configuration is not limited to this.

Figure 14:
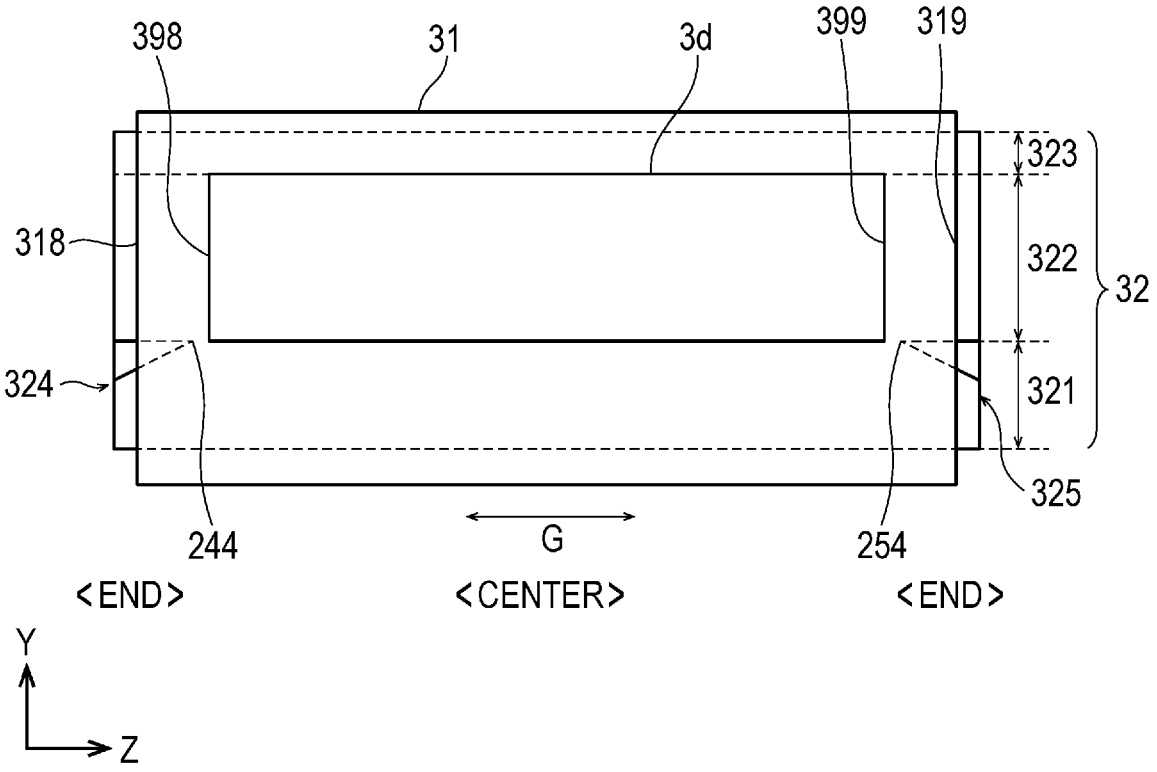
FIG. 14 is a diagram illustrating a configuration of a still another convex surface part according to a modification example.

For example, a configuration in which the tip ends 244 and 254 in the belt width direction of the convex surface parts 324 and 325 may be located closer to the edges 318 and 319 of the belt 31 in the belt width direction than the edges 398 and 399 of the nip formation area 3*d* as illustrated in FIG. 14, that is, a configuration in which tip ends 244 and 254 do not extend to the position of the edges 398 and 399 of the nip formation area 3*d* in the belt width direction may be employed. If the pressure at the ends in the belt width direction of the belt 31 at the position immediately before the fixing nip 3 has the pressure distribution described above, the lubricant J can be prevented from leaking from the edge of the belt 31.

(4) Although a configuration example in which the convex surface parts 324 and 325 as pressure application parts for generating the pressure distribution described above are provided at both ends in the belt width direction of the upstream guide 321 of the fixed pad 32 has been described in the above embodiment, the configuration is not limited to this.

Figure 15A:
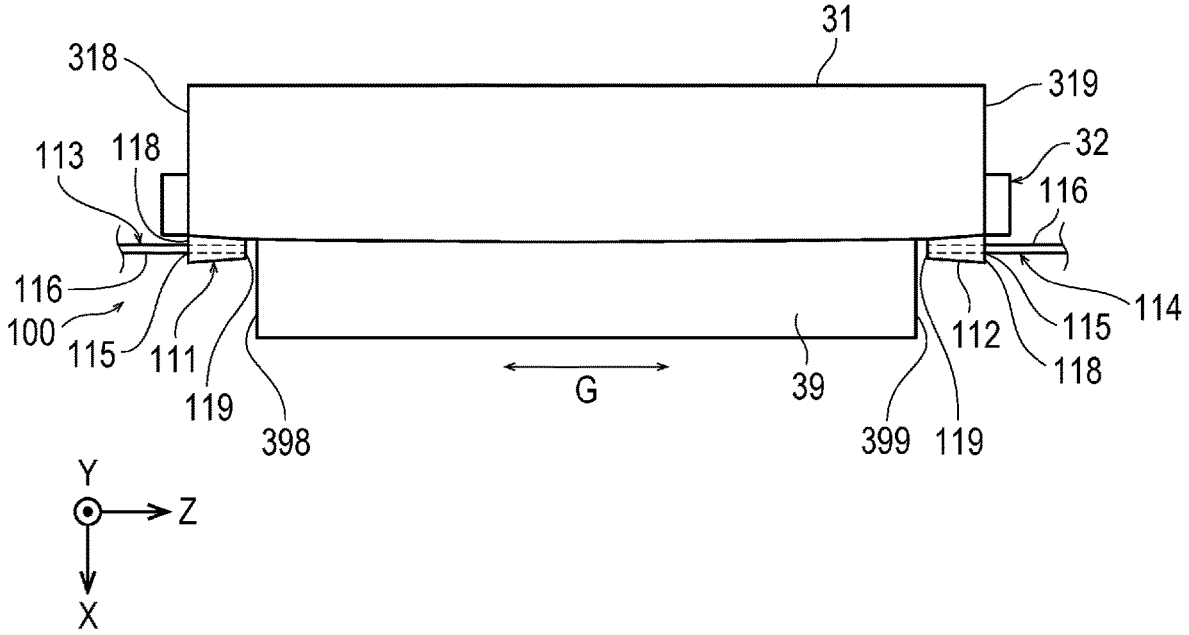
FIGS. 15A and 15B are diagrams illustrating a configuration of a pressure application part according to a modification example.

In the configuration in which the fixed pad 32 is not provided with the convex surface parts 324 and 325, for example, it is also possible to adopt a configuration in which a pressure application part 100 including truncated cone-shaped pressing rollers 111 and 112 as illustrated in FIG. 15A is provided on the outer peripheral side of the belt 31.

FIG. 15A is a schematic plan view of the belt 31, the fixed pad 32, the pressurizing roller 39, and the pressure application part 100 according to the present modification as viewed from above.

As illustrated in the drawing, the pressure application part 100 includes the truncated cone-shaped pressing rollers 111 and 112, and rotation shafts 113 and 114 that rotatably support the pressing rollers 111 and 112 around an axis passing through the center of the truncated cones.

The truncated cone-shaped pressing rollers 111 and 112 press the ends in the belt width direction of the belt 31 against the upstream guide 321 of the fixed pad 32 via the belt 31 at the position immediately before the fixing nip 3, and are disposed at positions that are on the side closer to the edges 318 and 319 of the belt 31 than the axial ends 398 and 399 of the pressurizing roller 39 and are slightly upstream of the pressurizing roller 39 in the belt circulating direction (upstream in the sheet conveyance direction). According to this arrangement, when viewed from the axial direction of pressurizing roller 39, an end of pressurizing roller 39 and a part of an end of pressing roller 111 (or 112) overlap with each other.

The rotation shaft 113 is parallel to the belt width direction, the pressing roller 111 is rotatably fitted to a tip end side 115 thereof, and a base end side 116 thereof is fixed to the frame. Similarly to the rotation shaft 113, the rotation shaft 114 is also parallel to the belt width direction, the pressing roller 112 is rotatably fitted to the tip end side 115 thereof, and the base end side 116 thereof is fixed to the frame.

Figure 15B:
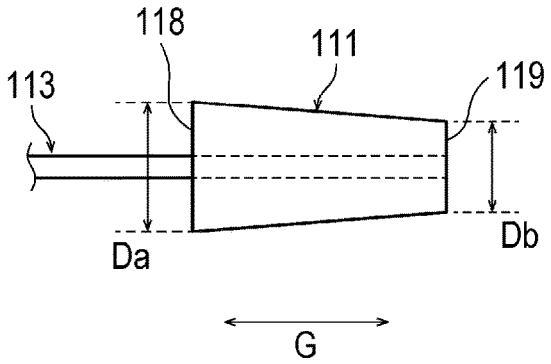

FIG. 15B is an enlarged view of the pressing roller 111, and the pressing roller 111 has a truncated cone shape having a relationship in which a diameter Da of one end 118 in the belt width direction is larger than a diameter db of the other end 119. Similarly, the other pressing roller 112 has a truncated cone shape in which the diameter Da of the end 118 is larger than the diameter db of the end 119. The pressing rollers 111 and 112 are fitted to the rotation shafts 113 and 114 in an orientation in which the large-diameter end 118 is directed to the end side in the belt width direction and the small-diameter end 119 is directed to the central side in the belt width direction.

Since the pressing rollers 111 and 112 have the truncated cone shape, the pressure in the belt width direction of the pressing force of the pressing rollers 111 and 112 pressing the upstream guide 321 of the fixed pad 32 via the belt 31 has a pressure distribution as indicated by the solid line in FIG. 7. As a result, similarly to the embodiment, it is possible to prevent the lubricant J from leaking from the edge of the belt 31.

(5) Although the convex surface parts 324 and 325 are provided at one end and the other end in the belt width direction in the embodiment described above, the configuration is not limited to this. For example, a configuration in which the convex surface part is provided only at one of the ends in the belt width direction may be employed. Specifically, there is a configuration in which the belt 31 gradually approaches either one end side or the other end side in the belt width direction during the circulation.

In such a configuration, the lubricant J applied on the inner peripheral surface of the belt 31 also easily flows in the same direction as the direction in which the belt 31 moves at the position immediately before the fixing nip 3, and the lubricant J easily leaks from the belt 31. In contrast, the lubricant J hardly leaks from the belt 31 in the direction opposite to the direction in which the belt 31 moves.

Therefore, even if the convex surface part is provided only at the end in the direction in which the belt 31 moves, the lubricant J can be prevented from leaking from the belt 31.

(6) Although a configuration example in which the heating roller 35 and the guide member 33 are used as stretching members that stretch the belt 31 together with the fixed pad 32 has been described in the above embodiment, the configuration is not limited to this. For example, there is also a configuration not including the guide member 33, and in this configuration example, the heating roller 35 serves as a stretching member. Further, in the electromagnetic induction system or the resistance heat generation system, in a configuration not including the heater 36, a configuration in which another driven roller is disposed as a stretching member instead of the heating roller 35 can be employed. In addition, in the configuration according to the modification example illustrated in FIG. 15A, it is also possible to employ a configuration in which a member that stretches the belt 31 is not provided, if the belt 31 is an elastic self-shape retainable belt capable of independently retaining a substantially cylindrical shape. In addition, in the case where the self-shape retainable belt is used in the example described above, a configuration in which a stretching member is not provided may be employed if the same pressure distribution as described above can be generated without providing the stretching member.

(7) Although a configuration example in which the lubricant supply member 38 for applying the lubricant J on the inner peripheral surface 311 of the belt 31 is provided has been described in the above embodiment, the configuration is not limited to this. For example, a configuration in which the lubricant supply member 38 is not provided can be employed. In this configuration, the lubricant J is applied on the inner peripheral surface 311 of the belt 31 by an operator at the time of manufacture or maintenance of the fixing part 30.

In addition, although a configuration example in which the sliding member 37 is provided has been described, the configuration is not limited to this, and a configuration in which the sliding member 37 is not provided may be employed as long as stable circulation of the belt 31 can be maintained. In this configuration, at the position immediately before the fixing nip 3, the entire area of the belt 31 in the belt width direction from the one end 318 to the other end 319 in the belt width direction is in direct contact with the upstream guide 321 of the fixed pad 32.

(8) Although a configuration in which the fixed pad 32 is fixedly supported by the support member 34, and the pressurizing roller 39 presses the fixed pad 32 via the belt 31 is employed in the embodiment described above, the configuration is not limited to this. The fixed pad 32 may be any member as long as the fixed pad 32 is a non-rotary member that does not rotate in accordance with the circulation of the belt 31, and for example, a configuration in which the fixed pad 32 presses the pressurizing roller 39 via the belt 31 by an urging force of an urging member such as a spring may be employed. Both cases are included in the configuration in which the pressurizing roller 39 presses the fixed pad 32 because a pressing force acts between the pressurizing roller 39 and the fixed pad 32.

(9) Although an example in which the image forming apparatus according to the present disclosure is applied to a color printer of a tandem type has been described in the above embodiment, the configuration is not limited to this. The embodiment can be applied to a fixing apparatus including an endless belt and an image forming apparatus including the fixing apparatus. For an image forming apparatus, the embodiment can be applied to an apparatus capable of executing color image formation or an apparatus capable of only executing monochromatic image formation, and can be applied to not only a printer but also an image forming apparatus such as a copier, a facsimile machine, or a multiple function peripheral (MFP).

The size, shape, material, number, numerical value, and the like of each member described above are mere examples, and the size, shape, material, number, numerical value, and the like of each member suitable for the device configuration are determined in advance.

In addition, the contents of the embodiment and the modification example may be combined as much as possible. A mechanism of each part or each member of the fixing part or the like may be replaced by a different mechanism or a member of a different shape as long as the effect of the present disclosure can be obtained.

The present disclosure can be widely applied to a fixing apparatus including an endless belt.

Although embodiments of the present invention have been described and illustrated in detail, the disclosed embodiments are made for purposes of illustration and example only and not limitation. The scope of the present invention should be interpreted by terms of the appended claims

What is claimed is:

1. A fixing apparatus that fixes an unfixed image on a sheet by causing the sheet to pass through a fixing nip formed by pressing a belt by a pressurizing roller, the belt having an endless shape, a lubricant being applied on an inner peripheral surface of the belt, the pressurizing roller being disposed on an outer peripheral side of the belt, the fixing apparatus comprising:

a non-rotary pad including a pressed part disposed on an inner peripheral side of the belt and pressed by the pressurizing roller via the belt, and a guide that is disposed upstream of the pressed part in a belt circulating direction and guides the belt to the fixing nip; and a pressure application part that applies a pressure between an end of the belt in a belt width direction and the guide at a position that is upstream of and immediately before the fixing nip in the belt circulating direction, the pressure gradually decreasing from the end side toward a central side in the belt width direction, wherein the guide includes a convex surface part that protrudes toward the inner peripheral surface of the belt at a position corresponding to the end of the belt, and the pressure application part is the convex surface part.

2. The fixing apparatus according to claim 1, wherein the convex surface part is formed in a tapered shape in which a length of the convex surface part in the belt circulating direction gradually decreases from the end side toward the central side in the belt width direction such that the pressure that gradually decreases is applied.

3. The fixing apparatus according to claim 1, wherein the convex surface part is formed in a shape in which a height of the convex surface part gradually decreases from the end side toward the central side in the belt width direction such that the pressure that gradually decreases is applied.

4. The fixing apparatus according to claim 2, wherein an end of the convex surface part on the central side in the belt width direction extends to a position closer to an axial center of the pressurizing roller than to an axial end of the pressurizing roller in the belt width direction.

5. The fixing apparatus according to claim 2, wherein the tapered shape includes a first side parallel to the belt width direction, and a second side disposed upstream of the first side in the belt circulating direction and inclined with respect to the first side.

6. The fixing apparatus according to claim 2, wherein a base end of the convex surface part on the end side in the belt width direction extends to an outside of the belt in the belt width direction.

7. A fixing apparatus that fixes an unfixed image on a sheet by causing the sheet to pass through a fixing nip formed by pressing a belt by a pressurizing roller, the belt having an endless shape, a lubricant being applied on an inner peripheral surface of the belt, the pressurizing roller being disposed on an outer peripheral side of the belt, the fixing apparatus comprising:

a non-rotary pad including a pressed part disposed on an inner peripheral side of the belt and pressed by the pressurizing roller via the belt, and a guide that is disposed upstream of the pressed part in a belt circulating direction and guides the belt to the fixing nip; and a pressure application part that applies a pressure between an end of the belt in a belt width direction and the guide at a position that is upstream of and immediately before the fixing nip in the belt circulating direction, the pressure gradually decreasing from the end side toward a central side in the belt width direction, wherein the pressure application part is a pressing roller having a truncated cone shape that presses the end of the belt against the guide from the outer peripheral side of the belt at the position immediately before the fixing nip, and the pressing roller is disposed in an orientation in which an end thereof having a larger diameter faces the end side in the belt width direction and an end thereof having a smaller diameter faces the central side in the belt width direction.

8. The fixing apparatus according to claim 1, wherein an axial end of the pressurizing roller is closer to a center of the belt in the belt width direction than an edge of the belt in the belt width direction.

9. The fixing apparatus according to claim 1, wherein an entire region of the belt from one end to another end in the belt width direction is in contact with the guide at the position immediately before the fixing nip.

10. The fixing apparatus according to claim 1, further comprising a low friction sheet interposed between the belt and the pad.

11. The fixing apparatus according to claim 10, wherein an entire region of the belt from one end to another end in the belt width direction is in contact with the guide via the low friction sheet at the position immediately before the fixing nip.

12. The fixing apparatus according to claim 1, further comprising a lubricant supply member that supplies the lubricant to the inner peripheral surface of the belt.

13. The fixing apparatus according to claim 1, wherein the pressure applied by the pressure application part is in a range of 1 to 200 kPa.

14. The fixing apparatus according to claim 2, wherein a height of the convex surface part is in a range of 0.1 to 0.5 mm.

15. An image forming apparatus comprising a fixing part that fixes an unfixed image formed on a conveyed recording sheet, wherein the image forming apparatus includes the fixing apparatus according to claim 1 as the fixing part.

* * * * *